US006279211B1

(12) United States Patent
Dischler

(10) Patent No.: US 6,279,211 B1
(45) Date of Patent: Aug. 28, 2001

(54) METHOD FOR CONTINUOUS CONDITIONING OF A BLANKET FOR A COMPRESSIVE SHRINKAGE APPARATUS

(75) Inventor: Louis Dischler, Spartanburg, SC (US)

(73) Assignee: Milliken & Company, Spartanburg, SC (US)

( * ) Notice: Subject to any disclaimer, the term of this patent is extended or adjusted under 35 U.S.C. 154(b) by 0 days.

(21) Appl. No.: 09/564,183

(22) Filed: May 4, 2000

(51) Int. Cl.[7] ..... D06C 21/00
(52) U.S. Cl. ..... 26/18.6; 26/28
(58) Field of Search ..... 26/18.6, 18.5, 26/27, 28, 69 A, 1; 28/142, 116, 122; 162/358.3, 272, 274; 198/837, 810.01, 842

(56) References Cited

U.S. PATENT DOCUMENTS

| | | | | |
|---|---|---|---|---|
| 2,146,694 | | 2/1939 | Wrigley et al. . | |
| 2,604,684 | * | 7/1952 | Kane | 26/28 |
| 2,706,845 | * | 4/1955 | Swan | 26/27 |
| 3,150,468 | * | 9/1964 | VanHuyzen | 26/28 |
| 3,469,292 | | 9/1969 | Hojyo | 26/69 |
| 3,597,814 | * | 8/1971 | Trifunovic | 26/18.6 |
| 3,866,277 | * | 2/1975 | Hojyo | 26/18.6 |
| 3,940,833 | * | 3/1976 | Troope et al. | 26/18.6 |
| 4,156,955 | | 6/1979 | Joy | 26/18.6 |
| 4,432,926 | * | 2/1984 | Van Tilburg et al. | 26/18.6 |
| 4,446,606 | | 5/1984 | LawreNce et al. | 26/18.6 |
| 4,480,362 | * | 11/1984 | Maxwell | 26/28 |
| 4,575,909 | * | 3/1986 | O'Brien et al. | 26/18.6 |
| 4,941,239 | * | 7/1990 | Fliss | 26/28 |
| 4,955,114 | | 9/1990 | Bertoldo | 26/18.6 |
| 5,233,733 | | 8/1993 | Rich et al. | 26/18.6 |
| 5,791,029 | | 8/1998 | Maker | 26/18.6 |

* cited by examiner

*Primary Examiner*—Amy B. Vanatta
(74) *Attorney, Agent, or Firm*—Terry T. Moyer; Sara M. Current

(57) ABSTRACT

A method for continuous conditioning of a rubber blanket such as the type used on compressive shrinkage apparatus is described. The blanket includes an inner bearing surface defining a bearing face and an outer surface defining a web-contacting face. The web-contacting face is contacted under pressure with an abrasive conditioning roll while the blanket is in its regular, web treating operation. The blanket working face can thus be continuously conditioned without the need for lengthy machine stops. In this way, the conventional grinding and cleaning operations can be minimized or eliminated.

29 Claims, 1 Drawing Sheet

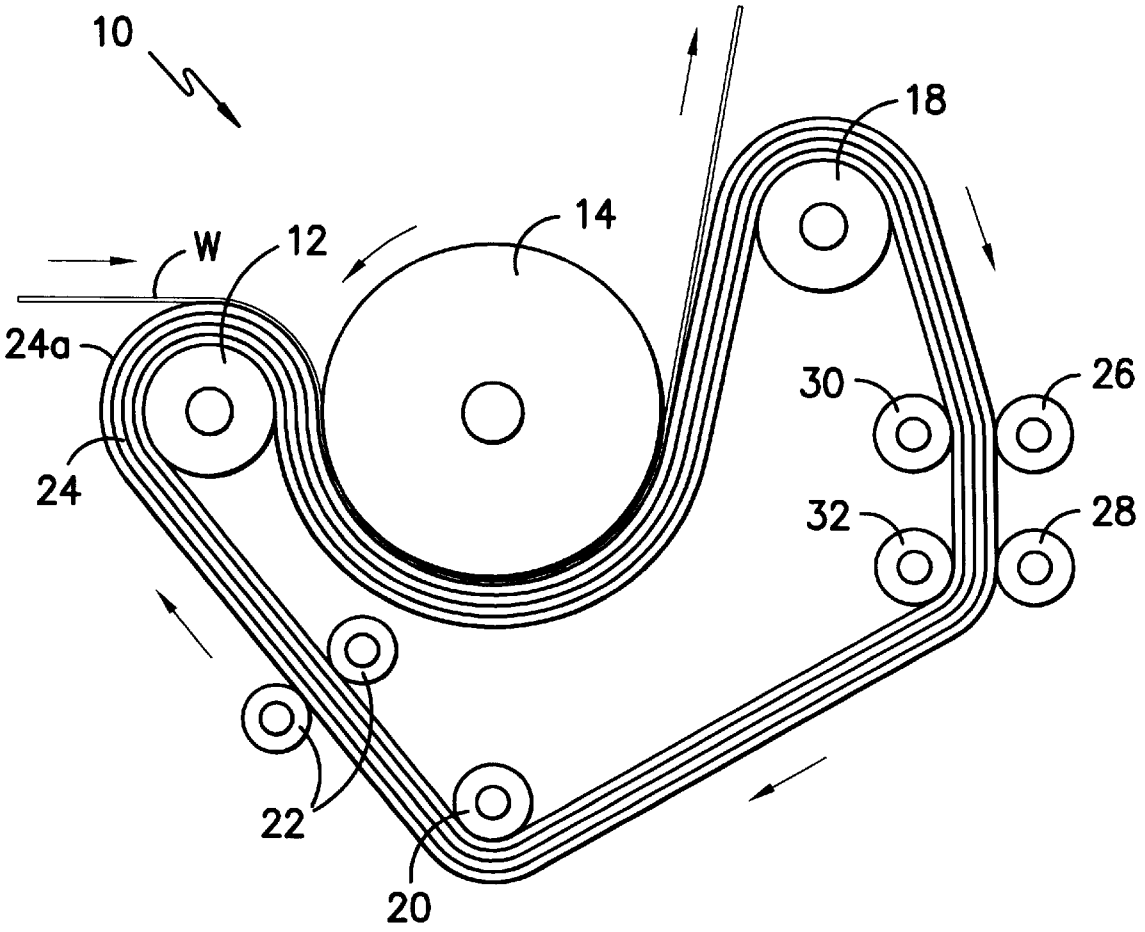
10
W
12
14
18
24a
24
30
26
32
28
22
20

METHOD FOR CONTINUOUS CONDITIONING OF A BLANKET FOR A COMPRESSIVE SHRINKAGE APPARATUS

FIELD OF THE INVENTION

The invention generally relates to a process for maintaining a consistent surface on and extending the lifespan of a continuous rubber blanket. More specifically, the invention relates to a process and apparatus for continuously conditioning a continuous rubber blanket such as the variety used in the compressive shrinkage of webs of material.

BACKGROUND

Many textile fabrics, and in particular those made wholly or partly from cellulosic fibers, have a tendency to shrink undesirably as a result of becoming wet or undergoing conventional laundering processes. To obviate undesirable shrinking, many such fabrics are customarily treated using a compressive or compaction shrinkage process, in order to pre-shrink the fabrics and increase their stability. Examples of compressive shrinkage processes are described in U.S. Pat. No. 2,146,694 to Wrigley, et al. and U.S. Pat. No. 3,469,292 to Hojyo, U.S. Pat. No. 4,156,955 to Joy, and U.S. Pat. No. 4,446,606 to Lawrence et al, the disclosures of which are incorporated herein by reference. Also, a popular compressive shrinkage process is known by the tradename SANFORIZE.

In compressive shrinkage processes, a fabric web is typically laid out over the working face of a thick endless rubber blanket so that it is free of folds or wrinkles. The rubber blanket is positioned on a plurality of rotatable rolls which support the blanket along its 10 bearing surface, and the blanket is typically conveyed along an endless path by way of a driven cylinder which contacts the outer blanket surface. In this way, the fabric web placed on the outer surface of the blanket is caused to be carried through a number of processing stations.

First, the fabric is typically moistened, then it is compressed along with the blanket between a roll and a heated cylinder or shoe. As the fabric and blanket pass between the nip (i.e., the point of contact between the two contiguous elements) and the blanket is compressed, adjacent portions of the outer surface of the blanket are caused to be extended. As the blanket and fabric leave the roll, the blanket contracts, and the fabric is forced to follow suit. As a result, the yarns in the warp direction are caused to shorten, and the filling yarns are pushed upwardly, thereby mechanically shrinking the fabric. The fabric is then fed to a dryer, where it is dried in its preshrunk condition.

Because the rubber blanket is endless, a web of fabric can be processed in a continuous manner. However, the surface of the rubber blanket must be cooled following contact with the heated cylinder before it again contacts the fabric web. Such cooling is generally performed by applying water to the blanket as it travels between the point of web removal and the point of untreated fabric web lay-down. Because too much moisture on the blanket can interfere with proper fabric conditioning, it is generally necessary that the amount of water on the blanket working surface be closely controlled. Generally this is performed by water removal rolls, which squeegee the excess water from the cooled blanket. Because it is important that the blanket stay properly lubricated, water is often added to the bearing surface of the blanket at various positions throughout the process, e.g., before the point of fabric lay-down and following contact of the blanket with the heated cylinder.

As should be apparent, the rubber blankets are exposed to great stresses during the compression shrinkage process as a result of the repeated heating and cooling, the tensions at which the blanket must be run on the machine, the compression forces endured by going through the nip, and the repeated wetting operations. Under these conditions, the working surface of the blanket slowly oxidizes. This results in an increase in hardness and a decrease in wettability. In addition, finishes present on the fabric surface are often transferred to the rubber surface. Over a relatively short time this finish tends to form a glaze on the rubber surface, further decreasing the wettability and friction characteristics of the surface. As will be readily appreciated by those of ordinary skill in the art, the reduction in frictional characteristics on the web-contacting surface of the blanket reduces its effectiveness in gripping the fabric web. As a result, the surface characteristics of the blanket must be modified to restore its frictional characteristics in order that it can continue to properly and uniformly process fabrics.

For example, in commercial applications, once the blanket hardness has been found to deviate upwardly or downwardly about 12% from its original level, blanket manufacturers recommend that the blanket be ground to remove the dead rubber on its surface. In this way, the surface of the blanket is prevented from becoming too slick or from losing its ability to grab hold of the fabric being treated. Such grinding is usually performed by stopping the machine and backing the rubber blanket up against a rotatable roll covered with abrasive material (e.g., grinding cloth or sandpaper), which grinds the working face of the rubber blanket until the dead rubber area has been removed.

Typically the grinding process requires the removal of about a sixteenth of an inch of the blanket surface with each grinding. Because, for example, a blanket which begins at 3 inches thick usually must remain at least two inches thick to work effectively, the number of grindings is thus very limited. As a result, the life of the rubber blanket used in these types of apparatus can be undesirably short.

It can also be appreciated that intermittent grinding of the blanket produces a surface that is variable over time, resulting in a greater amount of variability in compressive efficiency, and greater variability in the shrinkage characteristics of the final product. As the overall pre-shrinkage may need to be increased to avoid producing out-of-specification goods, the fabric yield will be less.

In addition, small cuts and nicks in the blanket can form and grow over time due to oxidation and the constant stretching and releasing of the blanket rubber surface. When the blanket is ground, additional blanket thickness must be sacrificed in order to insure that all cracks are removed. This contributes to a shorter blanket life.

During grinding of the blanket, production is halted, as the blanket must be ground dry to avoid premature decomposition or destruction of the grinding cloth or sandpaper. In addition, a considerable amount of rubber debris is formed due to the conventional grinding process. A heavy dusting of talc is typically applied during the grinding process, to reduce the friction and heat generated and to keep the blanket from becoming too sticky during the grinding operation. This talc and surplus rubber material must be cleaned from the blanket to prevent them from collecting on fabrics or materials being processed after the grinding operation.

In addition, blankets typically require frequent cleaning to remove the build-up of baked-on fabric finishes, oils, and the like. Again, production must be halted so that the blanket may be cooled, and detergents applied. However, if such finishes and oils are not removed on a timely basis, they can adversely affect the process performance as well as contribute to the decomposition of the rubber blanket.

The requirements of frequent cleaning and grinding prevent the rubber blanket machine from operating in-line with modern webprocessing equipment, which generally operate continuously, and which cannot economically be stopped to accommodate belt cleaning and grinding. A typical blanket grinding operation takes about 8 hours to perform, which is significant lost time from a fabric producer's perspective. Therefore, the grinding operation is recognized as being a significant source of machine downtime.

One attempt to increase the lifespan of blankets in compressive shrinkage apparatus is described in U.S. Pat. No. 5,791,029 to Maker, the disclosure of which is incorporated herein by reference. The '029 patent describes a rubber blanket construction having a bearing face which is beveled. The patentee describes that this construction reduces the tendency of the edges of the blanket to curve upwardly when the blanket is tensioned to perform a grinding operation and reduces the tendency of the edges to crack. While this method may reduce the tendency of the blanket to crack, it does not overcome the need for frequent blanket cleaning and grinding.

SUMMARY OF THE INVENTION

The present invention is directed to a process and apparatus for continuously conditioning the working face of a rubber blanket such as that used on compressive shrinkage apparatus. As a result, the useful life of the blanket can be extended to a significant extent. (For purposes of this invention, the term "rubber blanket" is intended to encompass all blankets useful in compressive shrinkage type apparatus, whether they are substantially all rubber, partially rubber, made from synthetic rubber, or the like. Similarly, although the term "continuously conditioning" is used, it is to be noted that this terminology encompasses substantially continuous conditioning methods of a like nature as well, and in particular, when the user has elected to discontinue the conditioning briefly for various reasons.)

Because the process of the instant invention can be readily incorporated into the regular machine processing operations (i.e., the web processing operation), the need for machine downtime to allow blanket grinding can be eliminated. This in turn enables the apparatus to be used more efficiently, by not requiring the machine downtime typically required for conventional blanket conditioning methods. In addition, existing compressive shrinkage machines can be readily retrofit to form the apparatus of the invention, thereby minimizing associated costs.

The invention achieves the above-noted advantages through the provision of an abrasive device, and in particular an abrasive roll, on the apparatus such that the abrasive roll is in contact with the working surface of the rubber blanket during regular operation of the compressive shrinkage apparatus during its regular web treatment process. In this way, the abrasive roll can provide a low level of consistent grinding for continuous periods of time. In a preferred form of the process, the abrasive roll contacts the blanket at substantially all times during operation of the machine and advancement of the blanket. Alternatively, the abrasive roll could be provided to contact the blanket less than 100% of the time the blanket is advancing (although constant contact is generally preferred.)

The speed of the abrasive roll relative to that of the working surface of the blanket can be adjusted to provide the desired amount of grinding. Preferably, only a small differential in speeds exists, such that a constant low level of grinding can be achieved. Similarly, the pressure of the abrasive roll against the blanket can be selected to achieve an optimal level of grinding. Furthermore, it is particularly preferred that the rotation of the abrasive roll is directly associated with the travel of the blanket, so that the grinding operation is halted simultaneously upon the cessation of blanket movement. In this way the formation of irregularities in the blanket surface as a result of the grinding operation can be minimized. In other words, in the embodiments of the invention where the grinding is directly associated with the blanket movement, the risk that the blanket will cease movement while grinding continues can be avoided (thereby avoiding the risk that irregular regions of greater grinding are formed.)

Surprisingly, a working surface having characteristics indistinguishable from that of the usual high speed dry grinding using talc may be achieved and consistently maintained, even in the hot and wet conditions typically associated with compressive shrinkage processes.

BRIEF DESCRIPTION OF THE DRAWINGS

FIG. 1 is a side elevational view of one embodiment of an apparatus of the instant invention.

DETAILED DESCRIPTION

In the following detailed description of the invention, specific preferred embodiments of the invention are described to enable a full and complete understanding of the invention. It will be recognized that it is not intended to limit the invention to the particular preferred embodiment described, and although specific terms are employed in describing the invention, such terms are used in a descriptive sense for the purpose of illustration and not for the purpose of limitation.

With reference to the drawing, FIG. 1 illustrates one embodiment of apparatus according to the present invention. Although described specifically to correspond with the illustrated apparatus, it is noted that the features of the invention can be included with other similar types of apparatus having a continuous blanket and in particular, other types and configurations of compressive shrinkage apparatus. In addition, although described in connection with the compressive shrinkage of textile fabrics (such as woven, knit and nonwoven fabrics), it is noted that the invention would have application to other types of compressive shrinkage apparatus, such as those designed to process paper webs.

The apparatus, shown generally at 10, desirably includes many of the elements included in a conventional compressive shrinkage apparatus. In particular, the apparatus 10 desirably includes a first roll 12, which cooperates with a heated drum 14 to form a nip 16 therebetween. The apparatus also desirably includes a tensioning roll 18, an idler roll 20, and water removal rolls 22. A rubber blanket 24 is positioned so that it extends around the rolls 12, 18, 20 and 22 in the manner illustrated. In this way, the rolls define a continuous path through which the blanket 24 travels during the web processing operation.

As illustrated, a web W is fed into the apparatus so that it extends in an overlying relationship to the web-contacting surface 24*a* of the blanket. In this way, the web of material W is compressed between the nip roll 12 and the heated drum 14 along with the blanket 24, so that it is compressively shrunk in a conventional manner.

In the illustrated embodiment of the invention, a first roll 26 is placed in pressure contact with the web-contacting surface of the blanket 24, and is allowed to be driven by the blanket at a synchronous surface speed. As will be appreciated by those of ordinary skill in the art, the surface texture and/or pressure at which the drive roll contacts the blanket enables the roll to be rotated upon an advancing motion by the blanket. Preferably, the surface of this first roll is abrasive (e.g. by way of a stippled or textured surface, or more preferably through the provision of grit particles on the surface of the roll.)

This drive roll 26 is then differentially geared to a second abrasive roll 28, also in pressure contact with the web-contacting surface of the blanket 24, so that it is driven at an asynchronous surface speed to the blanket. First and second backup rolls 30, 32 may also be provided in order to provide or increase pressure between the drive and abrasive rolls 26, 28.

In this way, the abrasive roll 28 serves to remove a portion of the web-contacting surface 24*a* of the blanket as the blanket circulates along its web-processing endless pathway. Therefore, grinding can be performed during the normal compressive shrinkage operation rather than as a separate operation.

As will be appreciated by those of ordinary skill in the art, by increasing the pressure of the abrasive roll 28 against the blanket, the span of contact between the roll and blanket is increased, thereby also increasing the rate of grinding. Furthermore, the differential speed (defined as the magnitude of the difference in the surface speed between the first and second rolls 26, 28, divided by the surface speed of the faster abrasive roll and multiplied by 100 percent) may vary from about 2 to 95 percent, but should preferably lie in the range of 5 to 50 percent, and most preferably in the range of about 8 to 25 percent. The pressure of the abrasive roll against the blanket is preferably about 20 to about 2000 pounds, and more preferably about 100 to about 1500 pounds, and most preferably about 200 to about 1000 pounds, such pressures being selected depending on, among other things, the speeds at which the machine is to be run and the amount of grinding desired.

The abrasive rolls may be geared together, but are preferably coupled by means of a synchronous (e.g. toothed) belt. However, other means for achieving the speed correlation between the rolls may be utilized within the spirit of the invention.

As noted above, pressure of the abrasive rolls against the blanket is preferably achieved by use of a back-up roll, most preferably with an individual back-up roll for each abrasive roll. In this way, a nip is created with the blanket running therebetween, with the abrasive roll loaded against the back-up roll, preferably by means of air cylinders. Two nips are preferably created. Utilizing this arrangement and two abrasive rolls, one can increase the pressure at one nip relative to the other, to thereby determine which roll serves as the drive roll, and which serves as the conditioning roll. This may be done intermittently, if desired, in order that the blanket can be abraded in both the forward and reverse directions.

As a further alternative, the abrasive roll 28 could be independently controlled by way of supplemental drive means, to grind the blanket while it proceeds through its regular web processing operation. However, the use of an abrasive roll which is rotated in response to blanket motion is preferred, since this reduces machinery complexity and reduces the opportunity for grinding-induced blanket defects. Furthermore, additional rolls could be utilized as desired, to provide additional amounts of and locations of grinding. In addition, although illustrated as being provided relatively close to the web take-off location, it is noted that the abrasive roll(s) can be provided anywhere other than web-contacting portions of the apparatus, within the scope of the invention.

The drive and abrasive rolls each desirably have abrasive surfaces. In particular, the abrasive rolls are preferably coated with diamond grit in the range of 60 to 400 grit, and more preferably in the range of 100 to 220 grit. The grit is preferably bonded directly to the roll by means of a metal matrix, where the metal is resistant to corrosion. In a preferred form of the invention, the metal matrix is selected from the group consisting of nickel, chromium, other metals with similar physical characteristics, or combinations thereof. The grit used for the drive roll and the conditioning roll may be different, thus allowing abrasion with two different grit sizes if the functions of the drive and conditioning rolls are interchanged by varying the nip pressures.

While a single roll may be used as a conditioning roll, (with a preferable surface speed of between 2 and 200 percent of blanket working surface speed) by driving the roll by means of a variable speed motor, or by belt or geared connection of drive elements of the compressive shrinkage apparatus itself, it is preferred that the conditioning roll be surface driven by the blanket, as this insures that the blanket is not accidentally damaged during a stoppage, when the roll might otherwise continue to rotate after the blanket has stopped. Surface driving of the conditioning roll also insures that the rate of conditioning is proportional to the blanket speed. Because the rate of blanket wear is also proportional to the blanket speed, the rate of conditioning and wear are balanced, insuring a consistent blanket surface.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In addition, although specific terms are employed, they are used in a generic and descriptive sense and not for purpose of limitation, the scope of the invention being defined in the claims. In the claims, means-plus-function clauses are intended to cover the structures described herein as performing the recited function and not only structural equivalents, but also equivalent structures.

I claim:

1. A method for conditioning the web-contacting face of an endless rubber blanket on a compressive shrinkage apparatus comprising the step of contacting the surface of a rubber blanket with an abrasive roll while said blanket is in a web-treating motion, such that said abrasive roll removes a portion of the surface of the blanket as the blanket proceeds in its web-treating motion.

2. A method according to claim 1, wherein said abrasive roll comprises diamond grit.

3. A method according to claim 2, wherein said diamond grit is bonded to said abrasive roll with a metal matrix.

4. A method according to claim 3, wherein said metal matrix is selected from the group consisting of nickel and chromium.

5. A method according to claim 1, wherein the abrasive roll is rotated in response to web-treating motion of the blanket.

6. An apparatus for compressively shrinking a web of material comprising:

an endless rubber blanket having a web contacting surface;

means for supporting and directing said blanket along an endless pathway through a plurality of processing positions;

means for removing a portion of the web-contacting surface of said blanket while said blanket is being directed along said pathway through a plurality of web processing stations, to thereby substantially continuously condition the web contacting surface of the blanket during web processing.

7. An apparatus according to claim 6, wherein said means for removing a portion of the web contacting surface comprises an abrasive roll.

8. An apparatus according to claim 7, wherein said abrasive roll comprises a metal roll having a rough surface.

9. An apparatus according to claim 8, wherein said metal roll has a plurality of grit particles embedded in its surface.

10. An apparatus according to claim 6, wherein said means for removing a portion of the web contacting surface comprises first and second cooperating rolls, with at least one of the rolls being driven by the blanket so that the removal of a portion of the blanket surface is ceased when the blanket ceases to move along the pathway.

11. An apparatus according to claim 10, wherein at least one of the rolls is adapted to frictionally grip the blanket.

12. An apparatus according to claim 10, wherein one of the rolls has greater slippage relative to the blanket than the other of the rolls.

13. An apparatus according to claim 12, wherein one of the rolls has greater friction relative to the blanket than the other of said rolls.

14. An apparatus according to claim 13, wherein said roll having greater friction relative to the blanket has a greater amount of grit on its surface than the other of the rolls.

15. An apparatus according to claim 7, wherein said abrasive roll comprises diamond grit.

16. An apparatus according to claim 15, wherein said diamond grit is bonded to said abrasive roll with a metal matrix.

17. An apparatus according to claim 16, wherein said metal matrix is selected from the group consisting of nickel and chromium.

18. An apparatus according to claim 9, wherein said grit particles comprise diamond grit.

19. A method of continuously conditioning a rubber blanket on a compressive shrinkage apparatus comprising the step of:

providing an abrasive roll in line with the web treating pathway of a compressive shrinkage apparatus such that said abrasive roll contacts the web-contacting surface of the blanket and removes a portion of the blanket surface as it travels along its web treating pathway.

20. A method according to claim 19, wherein said step of providing an abrasive roll comprises providing a metal roll having a rough surface.

21. A method according to claim 19, wherein said step of providing an abrasive roll comprises providing a metal roll having grit embedded in its surface.

22. A method according to claim 19, wherein said step of providing an abrasive roll comprises providing a roll having an abrasive surface formed by diamond grit embedded in a metal matrix.

23. A method according to claim 19, wherein said abrasive roll is adapted to rotate in response to motion by the blanket.

24. A method according to claim 19, further comprising the step of providing a drive roll adapted to rotate in response to motion by the blanket, wherein said drive roll is operatively associated with the abrasive roll to control the rotation thereof.

25. An apparatus for continuously conditioning the working surface of an endless rubber blanket on a compressive shrinkage apparatus, comprising:

a) a first rotatable roll in pressure contact with the web-contracting of said rubber blanket;

b) a second rotatable abrasive roll in pressure contact with the web-contacting face of said rubber blanket; and c) means for rotatably coupling said first rotatable abrasive roll with said second rotatable roll, such that rotation of the first rotatable roll causes said second rotatable abrasive roll to condition the surface of the rubber blanket.

26. An apparatus according to claim 25, wherein said means for rotatably coupling said first rotatable abrasive roll with said second rotatable abrasive roll comprises a toothed belt.

27. An apparatus according to claim 25, wherein said second rotatable abrasive roll comprises diamond grit.

28. An apparatus according to claim 27, wherein said diamond grit is bonded to said second rotatable abrasive roll with a metal matrix.

29. An apparatus according to claim 28, wherein said metal matrix is selected from the group consisting of nickel and chromium.

* * * * *